US005387011A

United States Patent [19]

Freund

[11] Patent Number: 5,387,011

[45] Date of Patent: Feb. 7, 1995

[54] SYSTEM AND METHOD FOR SCHEDULING A MEETING

[75] Inventor: William D. Freund, St. Louis, Mo.

[73] Assignee: Nextech Incorporated, Boston, Mass.

[21] Appl. No.: 127,151

[22] Filed: Sep. 27, 1993

[51] Int. Cl.[6] ..... B42D 15/00

[52] U.S. Cl. ..... 283/61; 283/62; 283/115; 281/2; 281/5; 434/430

[58] Field of Search ..... 283/34, 35, 115, 61, 283/62; 281/2, 5; 434/430, 431, 367, 368, 369, 370; 40/360

[56] References Cited

U.S. PATENT DOCUMENTS

| | | | |
|---|---|---|---|
| 3,565,462 | 2/1971 | Gottlieb | 434/430 X |
| 4,055,011 | 10/1977 | Longenecker | 40/124.1 |
| 4,194,196 | 3/1980 | Mohiuddin . | |
| 4,232,462 | 11/1980 | Longenecker | 40/119 |
| 4,319,771 | 3/1982 | Yglesias | 283/2 |
| 4,386,475 | 6/1983 | Krapf | 434/108 X |
| 4,451,067 | 5/1984 | Williams | 281/31 |
| 4,626,836 | 12/1986 | Curtis et al. | 40/107 X |
| 4,656,764 | 4/1987 | Fengler . | |
| 4,815,225 | 3/1989 | Wilen | 40/119 |
| 4,832,373 | 5/1989 | Swan | 283/115 |
| 5,011,191 | 4/1991 | Gannon et al. | 283/115 |
| 5,026,095 | 6/1991 | Hoyeck | 283/117 X |
| 5,333,908 | 8/1994 | Dorney et al. | 283/62 X |

*Primary Examiner*—Mark Rosenbaum
*Assistant Examiner*—Frances Han
*Attorney, Agent, or Firm*—Kenyon & Kenyon

[57] ABSTRACT

A system and method for scheduling a meeting uses several partially translucent sheets, one for each prospective attendee. Each partially translucent sheet contains an array of blocks of time, in which the rows correspond to time periods and the columns correspond to dates. The prospective attendee darkens the blocks corresponding to times that he is not available to attend the meeting, and sends the completed sheet to the organizer. The organizer then assembles the sheets, and stacks and aligns them so that the blocks line up. By viewing the stack of partially translucent sheets, preferably with a light source, the organizer can quickly identify the times when all prospective attendees are available for the meeting by identifying those blocks that remain translucent. If each prospective attendee uses the same type of writing apparatus so that the intensity of the darkened blocks is consistent among all the prospective attendees, then when the organizer assembles the sheets, if no time is available that all prospective attendees can meet, the next best time and date is the block that appears lightest. This allows the organizer to identify the times that the most people can attend the meeting, and not just the time when everyone can attend the meeting.

27 Claims, 3 Drawing Sheets

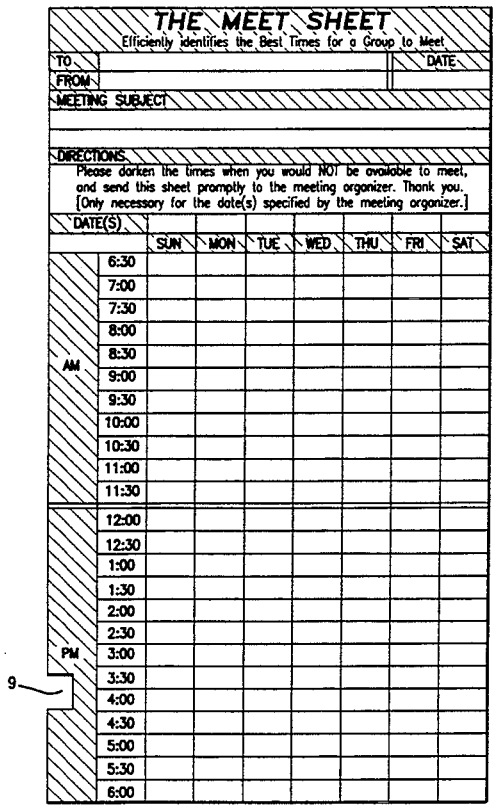

THE MEET SHEET

Efficiently identifies the Best Times for a Group to Meet

3 TO | DATE

4 FROM | 6

MEETING SUBJECT

5

DIRECTIONS

Please darken the times when you would NOT be available to meet, and send this sheet promptly to the meeting organizer. Thank you. [Only necessary for the date(s) specified by the meeting organizer.]

1 DATE(S)

| | | SUN | MON | TUE | WED | THU | FRI | SAT |
|---|---|---|---|---|---|---|---|---|
| AM | 6:30 | | | | | | | |
| | 7:00 | | | | | | | |
| | 7:30 | | | | | | | |
| | 8:00 | | | | | | | |
| | 8:30 | | | | | | | |
| | 9:00 | | | | | | | |
| | 9:30 | | | | | | | |
| | 10:00 | | | | | | | |
| | 10:30 | | | | | | | |
| | 11:00 | | | | | | | |
| | 11:30 | | | | | | | |
| PM | 12:00 | | | | | | | |
| | 12:30 | | | | | | | |
| | 1:00 | | | | | | | |
| | 1:30 | | | | | | | |
| | 2:00 | | | | | | | |
| | 2:30 | | | | | | | |
| | 3:00 | | | | | | | |
| | 3:30 | | | | | | | |
| | 4:00 | | | | | | | |
| | 4:30 | | | | | | | |
| | 5:00 | | | | | | | |
| | 5:30 | | | | | | | |
| | 6:00 | | | | | | | |

2

8

FIG. 1

THE MEET SHEET

Efficiently identifies the Best Times for a Group to Meet

| TO | | DATE |
|---|---|---|
| FROM | | |

MEETING SUBJECT

DIRECTIONS

Please darken the times when you would NOT be available to meet, and send this sheet promptly to the meeting organizer. Thank you. [Only necessary for the date(s) specified by the meeting organizer.]

| DATE(S) | | | | | | | | |
|---|---|---|---|---|---|---|---|---|
| | | SUN | MON | TUE | WED | THU | FRI | SAT |
| AM | 6:30 | | | | | | | |
| | 7:00 | | | | | | | |
| | 7:30 | | | | | | | |
| | 8:00 | | | | | | | |
| | 8:30 | | | | | | | |
| | 9:00 | | | | | | | |
| | 9:30 | | | | | | | |
| | 10:00 | | | | | | | |
| | 10:30 | | | | | | | |
| | 11:00 | | | | | | | |
| | 11:30 | | | | | | | |
| PM | 12:00 | | | | | | | |
| | 12:30 | | | | | | | |
| | 1:00 | | | | | | | |
| | 1:30 | | | | | | | |
| | 2:00 | | | | | | | |
| | 2:30 | | | | | | | |
| | 3:00 | | | | | | | |
| | 3:30 | | | | | | | |
| | 4:00 | | | | | | | |
| | 4:30 | | | | | | | |
| | 5:00 | | | | | | | |
| | 5:30 | | | | | | | |
| | 6:00 | | | | | | | |

9

FIG.2

THE MEET SHEET

Efficiently identifies the Best Times for a Group to Meet

TO | DATE

FROM

MEETING SUBJECT

DIRECTIONS

Please darken the times when you would NOT be available to meet, and send this sheet promptly to the meeting organizer. Thank you. [Only necessary for the date(s) specified by the meeting organizer.]

| DATE(S) | | | 9/13/93 | | | | | |
|---|---|---|---|---|---|---|---|---|
| | | SUN | MON | TUE | WED | THU | FRI | SAT |
| AM | 6:30 | | | | | | | |
| | 7:00 | | | | | | | |
| | 7:30 | | | | | | | |
| | 8:00 | | | | | | | |
| | 8:30 | | | | | | | |
| | 9:00 | | | | | | | |
| | 9:30 | | | | | | | |
| | 10:00 | | | | | | | |
| | 10:30 | | | | | | | |
| | 11:00 | | | | | | | |
| | 11:30 | | | | | | | |
| PM | 12:00 | | | | | | | |
| | 12:30 | | | | | | | |
| | 1:00 | | | | | | | |
| | 1:30 | | | | | | | |
| | 2:00 | | | | | | | |
| | 2:30 | | | | | | | |
| | 3:00 | | | | | | | |
| | 3:30 | | | | | | | |
| | 4:00 | | | | | | | |
| | 4:30 | | | | | | | |
| | 5:00 | | | | | | | |
| | 5:30 | | | | | | | |
| | 6:00 | | | | | | | |

FIG.3

SYSTEM AND METHOD FOR SCHEDULING A MEETING

BACKGROUND OF THE INVENTION

The present invention relates generally to systems and methods for scheduling a meeting, and more particularly to a system and method for scheduling a meeting that does not require the use of a computer or other electronic device.

Many computerized systems exist that allow individuals to coordinate and schedule meetings involving large numbers of people. While these systems perform this task well, they all generally require each person to have a computer, or similar device. Often, however, some of the people who should be attending the meeting do not have access to a computer, or are not particularly computer literate. For these people, contact must be through means other than the computer, and someone else must input the schedules of these people into the computer for them. At worst, some individuals are accidentally left out of the meeting, not notified of the meeting, or are not offered the opportunity to provide input to the scheduling of the meeting. In addition, during a meeting one might wish to schedule a follow-up meeting while all the attendees are present. Despite the widespread use of computers in society today, however, most people attending a meeting do not bring computers, especially ones that can communicate with all other computers in the room. Finally, computerized systems are expensive, and sometimes difficult to use.

The present invention is directed to the problem of developing a system and method for scheduling a meeting that is inexpensive and which does not rely on a computer or other electronic device, yet allows one to schedule a meeting for large numbers of people quickly and easily.

SUMMARY OF THE INVENTION

The present invention solves this problem by providing several partially translucent sheets, on which prospective attendees can indicate which times they will be available or not available to attend the meeting. Each partially translucent sheet contains an array of blocks of time, in which the rows correspond to time periods and the columns correspond to dates. Each prospective attendee darkens the blocks corresponding to the times that he is not available to attend the meeting, and sends the completed sheet to the organizer. The organizer then assembles the sheets, and stacks them and aligns them so that the blocks line up. By viewing the stack of partially translucent sheets, preferably with a light source, the organizer can quickly identify the times when all prospective attendees are available for the meeting, i.e., those blocks of time that remain partially translucent.

In an advantageous embodiment of the present invention, each prospective attendee uses the same type of writing apparatus so that the intensity of the darkened blocks remains consistent among all the prospective attendees. When the organizer then assembles the sheets, if no time is available that all prospective attendees can meet, the next best time and date corresponds to the block that appears lightest. In this way, the organizer can identify the times that most people can attend the meeting, and not just the time when everyone can attend the meeting. This allows the organizer to quickly identify the best time to meet even when an ideal time does not exist.

In an alternate embodiment of the present invention, the sheets are designed so that the prospective attendee blocks the dates that he is available for the meeting. The prospective attendee then uses a marker that makes a mark on the partially translucent sheet, so that when multiple sheets are stacked, and each has a mark in the same place, the marks become successively darker when viewed in a stack, as the number of sheets increases in the stack. In this embodiment, the block that appears darkest indicates the best time to schedule the meeting.

In another alternate embodiment of the present invention, the sheets are designed so that each prospective attendee punches a hole in the blocks corresponding to times when he is available. Preferably, each attendee uses a standard hole puncher so that the holes are similar. The sheets are made of a partially translucent material, such that when looking through a stack of these sheets the stack appears progressively darker as the number of sheets increases. The organizer then stacks and aligns the sheets. In this embodiment, the blocks with holes all the way through the stack indicate the best times to schedule the meeting. Furthermore, if none of the blocks have holes passing through the stack, then the lightest block indicates the date and time when more of the attendees can attend the meeting than any other date and time. In this embodiment, opaque paper could be used in place of the partially translucent paper so that only the blocks having holes completely through the paper would pass light. This would allow one to quickly identify the best times when everyone could meet, but not necessarily the times when most people could meet. Furthermore, a hole punch could be avoided by using paper with perforated circles in the blocks, which the user could convert into holes by removing the center portion without using a hole punch. This would have the advantage of guaranteeing that the holes line up precisely.

In a third alternate embodiment of the present invention, the sheets are designed so that each prospective attendee punches a hole in the blocks corresponding to times when he is not available. The sheets are made of a partially translucent material, such that when looking through a stack of these sheets the stack appears progressively darker as the number of sheets increases. The organizer then stacks and aligns the sheets. In this embodiment, the darkest blocks indicate the best times to schedule the meeting.

In a fourth alternate embodiment of the present invention, the sheets are designed so that each prospective attendee applies a sticker to the blocks corresponding to times when he is available. As before, the sheets are made of a partially translucent material, such that when the sheets are stacked and one views the stack, the blocks having more stickers appear darker as the number of stickers increase. The organizer then stacks and aligns the sheets. In this embodiment, the white blocks indicate the best times to schedule the meeting. Furthermore, if none of the blocks are white, then the lightest block indicates the date and time when more of the attendees can attend the meeting than any other date and time.

An additional feature of the present invention uses an alignment device to allow the organizer to quickly align the sheets. This alignment device could simply be a notch in the sheets in a location asymmetric to the center, a two-ring or three-ring hole, or an asymmetric shading pattern on each sheet. In each case, the asymmetry must be with respect to the center to allow one to quickly identify the top and left side of the sheet.

Finally, a last embodiment of the present invention uses different colored markers for different groups of people. In this way, one can easily determine which groups of people can attend at which times. For example, by requesting that all people essential to the meeting complete the form using a black marker, and all people whose presence would be nice, but not essential complete the form using a colored marker, the organizer could easily determine when all the essential people can attend. If the attendees darken the blocks corresponding to the time they cannot attend, the blocks which are colored, but not blackened, would indicate times which are acceptable, even if not convenient for everyone. Thus, one can quickly identify the best time even if an ideal time does not exist.

BRIEF DESCRIPTION OF THE DRAWINGS

FIG. 1 depicts one embodiment of a partially translucent sheet used in the system and method of the present invention.

FIG. 2 depicts an embodiment of the alignment device of the system and method of the present invention.

FIG. 3 depicts the plurality of sheets when stacked and aligned so that the lightest blocked area indicates the preferred time.

DETAILED DESCRIPTION

FIG. 1 depicts a partially translucent sheet used in the system and method of the present invention. As used herein, partially translucent means that the sheet has the property that when several of these sheets are stacked, one can determine that a block has been darkened on the bottom sheet. Obviously, completely transparent sheets would suffice, as would completely translucent sheets. The following types of papers have been determined to have this partially translucent quality: thin paper, such as tracing paper, acetate (i.e., transparency paper), and plastic. Of the tracing paper, the brand found to satisfy the requirements of the present invention is "Dick Blick" brand, 25 lb. weight.

FIG. 1 depicts a partially translucent sheet having multiple blocks corresponding to dates and a time periods. The dates are indicated at the headings 1 of each column, while the time periods are indicated at the heading 2 of each row. In this embodiment of the present invention, the time periods are organized into half hour periods, and the dates are broken down into days of the week. Essentially, this is a generic weekly calendar separating the days into time blocks. By filling in the actual date, such as Mar. 13, 1993, the user can specify a precise date in the column heading 1. The rows could also be organized by the hour or any other convenient time period depending on the desired detail and length of the meetings. For example, one might wish to specify mornings and afternoons only when trying to schedule meetings that would occupy all morning or all afternoon. Whereas, one might wish to specify fifteen minute blocks when trying to schedule brief meetings.

The method of the present invention thus operates as follows. First, the organizer of the meeting prepares one form for each prospective attendee. To complete the form, the organizer writes the prospective attendee's name in the TO block 3, the organizer's name in the FROM block 4, the subject of the meeting in the MEETING SUBJECT block 5, the date the organizer fills out the form in the DATE block 6, and the proposed dates that the organizer wishes to schedule the meeting in the DATE block 1. The organizer does not have to place dates under all the dates of the week, unless all the dates of the week are available for the meeting. For example, if the meeting can only occur on Monday, Tuesday or Wednesday of Sep. 13, 14 and 15 of 1993, the organizer writes in the dates Sep. 13, 1993, Sep. 14, 1993 and Sep. 15, 1993 below MON, TUE and WED, respectively, in block 1. This indicates to each prospective attendee that these are the only dates that the organizer can schedule the meeting, and therefore, the blocks in these columns are the only ones that the prospective attendee needs to darken out, if he cannot attend at that date and time.

Once the organizer completes the form he distributes the forms to the prospective attendees. The organizer could also speak with each prospective attendee and then fill out a form based on the information that each prospective attendee provides him. In the blocks below the dates that were indicated by the organizer as proposed dates for the meeting, each prospective attendee darkens those blocks of time when the prospective attendee cannot attend the meeting. Then each prospective attendee returns the completed form to the organizer.

Once the organizer receives the completed forms, the organizer stacks them and aligns them so that the blocks line up. By viewing the stack though a light source, the organizer can easily determine the time period and the date which all attendees can attend the meeting by noting those blocks that remain partially translucent when viewed through a light source.

If all of the prospective attendees use a writing apparatus of the same consistency, the block that appears lightest to the organizer will be the date when the highest number of attendees can attend the meeting. For example, if all of the prospective attendees use the same type of permanent marker, such as the Sanford ® King Size TM Permanent Marker (Item #15000), when darkening the blocks of times that they cannot attend, then when viewed with a light source, the block that appears lightest will be the time and date when the largest number of attendees can attend. While other writing apparatuses will work, the key is that all of the attendees use the same type. The above type of permanent marker will work effectively with the thin tracing paper mentioned above. Alternatively, the combination of a grease pencil and acetate will work effectively.

FIG. 2 depicts one embodiment of an alignment device to quickly and easily align the sheets. A notch 9 is provided on each sheet so that one can align the sheets by aligning the notches. By placing the cards in a holder that has a projection fitting into the notch, one could easily align the sheets to determine the best times for scheduling the meeting. The notch could also be simply a punched hole, or several holes, such as those for a three-ring binder.

Another technique for performing this alignment uses an asymmetric shading 8 on the sheet, for example, as depicted in FIG. 1. The asymmetry must be with respect to the center of the sheet, so that one can easily identify the top of the sheet when looking through the stack, as well as the left and right sides. By looking through the stack and seeing shaded areas that do not align, the organizer can quickly determine that the sheets are not properly aligned.

The method and system of the present invention allows one to pass out these sheets during a meeting to all of the attendees. Once the sheets have been completed, the organizer then collects the sheets, and stacks and aligns the sheets. If an overhead projector is available, the organizer simply places the stacked and aligned sheets on the overhead projector, thus allowing the attendees to view the results of the scheduling system. Thus, a quick and inexpensive system for scheduling a meeting has been described.

FIG. 3 depicts one embodiment of the plurality of sheets according to the present invention, after the prospective attendees have completed the sheets and returned them to the organizer, who then stacked and aligned the sheets. Since only Monday, Sep. 13, 1993 was filled in by the user, only that column was completed by the prospective attendees. Assuming that the prospective attendees darkened the blocks corresponding to the times during which they could not attend the meeting, the lightest blocks indicate the best times to schedule the meeting. In the case depicted in FIG. 3, 6:00 p.m. to 6:30 p.m. would be the best time window in which to meet since none of the prospective attendees darkened this time. The next best time to meet would be 6:30 a.m. to 7:30 a.m. Clearly, the worst time window would be 12:00 p.m. -2:00 p.m. However, if the attendees darkened the blocks when they could attend, then 12:00 p.m. -2:00 p.m. would be the best time to schedule the meeting.

While the drawings and the above description depict the embodiment of the present invention in which the attendee darkens those blocks during which he cannot attend the meeting, the sheets could be designed so that the prospective attendee blocks the dates that he is available for the meeting. The prospective attendee then uses a marker that makes a mark on the sheet that is partially translucent, so that when multiple sheets are stacked, each having a mark in the same place, the marks become successively darker when viewed in a stack as the number of sheets in the stack increases. In this embodiment, the block that appears darkest indicates the best time to schedule the meeting.

Alternatively, the sheets can be designed so that each prospective attendee punches a hole in the blocks corresponding to times when he is available. In this approach each attendee uses a standard hole puncher to guarantee that the holes remain consistent. The sheets are made of a partially translucent material, such that when the sheets are stacked the stack appears progressively darker as the number of sheets increases. The organizer then stacks and aligns the sheets. In this embodiment, the blocks with holes all the way through the stack indicate the best times to schedule the meeting. Furthermore, if none of the blocks have holes passing through the stack, then the lightest block indicates the date and time when more of the attendees can attend the meeting than any other date and time.

In this embodiment, opaque paper (i.e., black or colored construction paper) could be used in place of the partially translucent paper so that only the blocks having holes completely through the paper would pass light. This would allow one to quickly identify the best times when everyone could meet, but not necessarily the times when most people could meet.

Furthermore, a hole punch could be avoided by using paper with perforated circles in the blocks, which the user could convert into holes by removing the center portion without using a hole punch. This would have the advantage of guaranteeing that the holes line up precisely As with the other alternative approach, the sheets can be designed so that each prospective attendee punches a hole in the blocks corresponding to times when he is not available. The sheets are made of a partially translucent material, such that when multiple sheets are stacked, they appear darker as the number of sheets increases. The organizer then stacks and aligns the sheets. In this embodiment, the darkest blocks indicate the best times to schedule the meeting.

In another alternative, the sheets are designed so that each prospective attendee applies a sticker to the blocks corresponding to times when he is available. As before, the sheets are made of a partially translucent material, such that when the sheets are stacked the blocks having more stickers appear darker as the number of stickers increases. The organizer then stacks and aligns the sheets. In this embodiment, the white blocks indicate the best times to schedule the meeting. Furthermore, if none of the blocks are white, then the lightest block indicates the date and time when more of the attendees can attend the meeting than any other date and time.

In a last alternative of the present invention, the organizer would request that different groups of people use different colored markers. In this way, one could easily determine which groups of people can attend at which times. For example, by requesting that all people essential to the meeting complete the form using a black marker, and all people whose presence would be nice, but not essential complete the form using a colored marker, the organizer could easily determine when all the essential people can attend. The blocks which are colored, but not blackened would indicate times that are acceptable, even if not convenient for everyone.

What is claimed is:

1. A system for scheduling a meeting comprising a plurality of at least partially translucent sheets, each of which includes a plurality of blocked areas, each blocked area corresponding to predetermined date and a predetermined time period, and each blocked area being capable of being marked by a user, whereby said plurality of at least partially translucent sheets can be stacked and aligned so that blocked areas from said plurality of at least partially translucent sheets corresponding to a same predetermined time period and a same predetermined date are aligned with each other, thereby allowing the determination of blocked areas on the plurality of at least partially translucent sheets that have not been marked.

2. The system according to claim 1, wherein each blocked area is capable of being darkened.

3. The system according to claim 1, wherein each blocked area is capable of having a hole punched through it.

4. The system according to claim 1, wherein each blocked area comprises a perforated circle.

5. The system according to claim 1, wherein each blocked area is capable of having a sticker pasted on it.

6. The system according to claim 1, wherein each of said plurality of at least partially translucent sheets further comprises a plurality of column headings indicating a weekday and a plurality of row headings indicating a time period.

7. The system according to claim 1, wherein each attendee of a meeting to be scheduled receives one of the plurality of at least partially translucent sheets and darkens those blocked areas on said one sheet that correspond to particular dates and particular time periods during which the attendee cannot attend the meeting if it were to be scheduled on that particular date and during that particular time period.

8. The system according to claim 7, further comprising a similar writing apparatus for each attendee, wherein each attendee darkens the blocked areas using said similar writing apparatus so that all marks have a similar intensity, whereby when determining when to schedule the meeting that blocked area appearing lightest to the user when held up to a light source indicates a date and time period during which more attendees can attend the meeting than any other date and time period.

9. The system according to claim 1, wherein said plurality of sheets further comprises a plurality of shaded areas that do not pass light, whereby the user can easily align the plurality of sheets when stacking said plurality of sheets.

10. The system according to claim 9, wherein said shaded areas contain information defining the blocked areas and describing how to complete the sheet.

11. The system according to claim 1, wherein each of said plurality of at least partially translucent sheets comprises a plastic material.

12. The system according to claim 1, wherein each of said plurality of at least partially translucent sheets comprises an acetate material.

13. The system according to claim 1, wherein each of said plurality of at least partially translucent sheets comprises thin paper.

14. The system according to claim 1, wherein each of said plurality of at least partially translucent sheets comprises tracing paper.

15. The system according to claim 1, wherein each of said plurality of sheets further comprises an alignment device allowing the plurality of sheets to be quickly and properly aligned when stacked.

16. The system according to claim 15, wherein the alignment device comprises a notch disposed in a location being asymmetric to a center of the sheet.

17. The system according to claim 15, wherein the alignment device comprises an asymmetric shading disposed on the sheet at a location asymmetric with respect to a center of the sheet, whereby a top and a right or left side can be easily determined.

18. The system according to claim 1, wherein the blocks of said plurality of at least partially translucent sheets are capable of being darkened with black and at least one other color, whereby said plurality of at least partially translucent sheets can be stacked and aligned so that blocked areas from said plurality of at least partially translucent sheets corresponding to a same predetermined time period and a same predetermined date are aligned with each other, thereby allowing the determination of blocked areas on the plurality of at least partially translucent sheets that have not been marked with black.

19. A method for scheduling a meeting with a plurality of attendees, comprising the steps of:

a) assembling scheduling information regarding availability of the plurality of attendees by marking particular blocked areas of a plurality of blocked areas on a plurality of at least partially translucent sheets, wherein each blocked area corresponds to a particular date and time period, and one partially translucent sheet is marked for each of the plurality of attendees;

b) stacking and aligning the plurality of at least partially translucent sheets so that blocked areas corresponding to a same time period and date lie on top of each other; and c) viewing the plurality of at least partially translucent sheets through a light source to determine which blocked areas have been marked.

20. The method according to claim 19, wherein the step of assembling further comprises darkening those blocked areas corresponding to those dates and time periods when the attendees cannot attend the meeting.

21. The method according to claim 20, wherein the step of viewing further comprises viewing the plurality of at least partially translucent sheets to determine if any blocked areas remain unmarked by all of the attendees.

22. The method according to claim 19, wherein the step of viewing further comprises viewing the plurality of at least partially translucent sheets to determine the lightest blocked area, wherein said lightest blocked area corresponds to that date and time period when more of the attendees can attend the meeting than any other date and time period.

23. The method according to claim 19, wherein the step of assembling further comprises darkening those blocked areas corresponding to those dates and time periods when the attendees can attend the meeting, and the step of viewing further comprises viewing the plurality of sheets to determine the darkest blocked area, wherein said darkest blocked area corresponds to that date and time period when more of the attendees can attend the meeting than any other date and time period.

24. The method according to claim 19, wherein the step of assembling further comprises darkening with black those blocked areas corresponding to those dates and time periods when a first group of the plurality of attendees cannot attend the meeting, and darkening with a non-black color those blocked areas corresponding to those dates and time periods when a second group of the plurality of attendees cannot attend the meeting, and the step of viewing further comprises viewing the plurality of sheets to determine the lightest non-black blocked area, wherein said lightest non-black blocked area corresponds to that date and time period when all of the first group and more of the second group of attendees can attend the meeting than any other date and time period.

25. A method for scheduling a meeting with a plurality of attendees, comprising the steps of:

a) assembling scheduling information regarding availability of the plurality of attendees by punching a hole in particular blocked areas of a plurality of blocked areas on a plurality of at least partially translucent sheets, wherein each blocked area corresponds to a particular date and time period, and one sheet is marked for each of the plurality of attendees;

b) stacking and aligning the plurality of at least partially translucent sheets so that blocked areas corresponding to a same time period and date lie on top of each other; and c) viewing the plurality of at least partially translucent sheets through a light source to determine which blocked areas have been marked.

26. The method according to claim 25, wherein the step of assembling further comprises punching a hole in those blocked areas corresponding to those dates and time periods when the attendees cannot attend the meeting, and the step of viewing further comprises viewing the plurality of at least partially translucent sheets to determine the darkest blocked area, wherein said darkest blocked area corresponds to that date and time period when more of the attendees can attend the meeting than any other date and time period.

27. The method according to claim 25, wherein the step of assembling further comprises punching a hole in those blocked areas corresponding to those dates and time periods when the attendees can attend the meeting, and the step of viewing further comprises viewing the plurality of sheets to determine the lightest blocked area, wherein said lightest blocked area corresponds to that date and time period when more of the attendees can attend the meeting than any other date and time period.

* * * * *